United States Patent [19]

Choma et al.

[11] 4,248,193

[45] Feb. 3, 1981

[54] FUEL INJECTION FUEL CONTROL SYSTEM

[75] Inventors: Michael A. Choma; Aladar O. Simko, both of Dearborn Heights; Michael M. Schechter, Southfield; Wallace R. Wade, Farmington Hills, all of Mich.

[73] Assignee: Ford Motor Company, Dearborn, Mich.

[21] Appl. No.: 939,005

[22] Filed: Sep. 1, 1978

[51] Int. Cl.[3] ..... F02P 5/04; F02M 25/06; F02D 1/02

[52] U.S. Cl. ..... 123/341; 123/350; 123/382; 123/408; 123/568

[58] Field of Search ..... 123/119 A, 117 A, 117 R, 123/140 MC, 140 MP, 140 FG, 139 E, 139 AW

[56] References Cited

U.S. PATENT DOCUMENTS

| | | | |
|---|---|---|---|
| 2,486,816 | 11/1949 | Beeh | 123/140 MC |
| 2,851,025 | 9/1958 | Dahl | 123/140 MC |
| 3,128,751 | 4/1964 | Dahl et al. | 123/140 MC |
| 3,791,144 | 2/1974 | Lang | 123/117 A |
| 4,105,001 | 8/1978 | Hartel | 123/140 MC X |
| 4,124,006 | 11/1978 | Rodenkirch | 123/117 A X |

*Primary Examiner*—Tony M. Argenbright
*Attorney, Agent, or Firm*—Robert E. McCollum; Clifford L. Sadler

[57] ABSTRACT

FIG. 1 schematically shows a fuel control system for a fuel injected engine. The system includes two vacuum control circuits, essentially identical in valve structure. One circuit controls the recirculation of exhaust gases into the engine intake manifold 14 and a change in engine ignition timing in response to engine throttle valve 34 angle by a regulator 310, in response to changes in engine temperature by a signal reducer 312, and in response to engine load by a manifold vacuum sensitive valve 314. A second circuit controls the engine fuel injection pump fuel flow rate as a function of changes in throttle valve angle by a valve 420, engine temperature levels by a valve 422, and load levels by a valve 424 to adjust an engine air/fuel ratio controller 52 to maintain either a base air/fuel ratio or air/fuel ratios as called for by the particular engine operating conditions.

21 Claims, 3 Drawing Figures

FUEL INJECTION FUEL CONTROL SYSTEM

Figure 1:
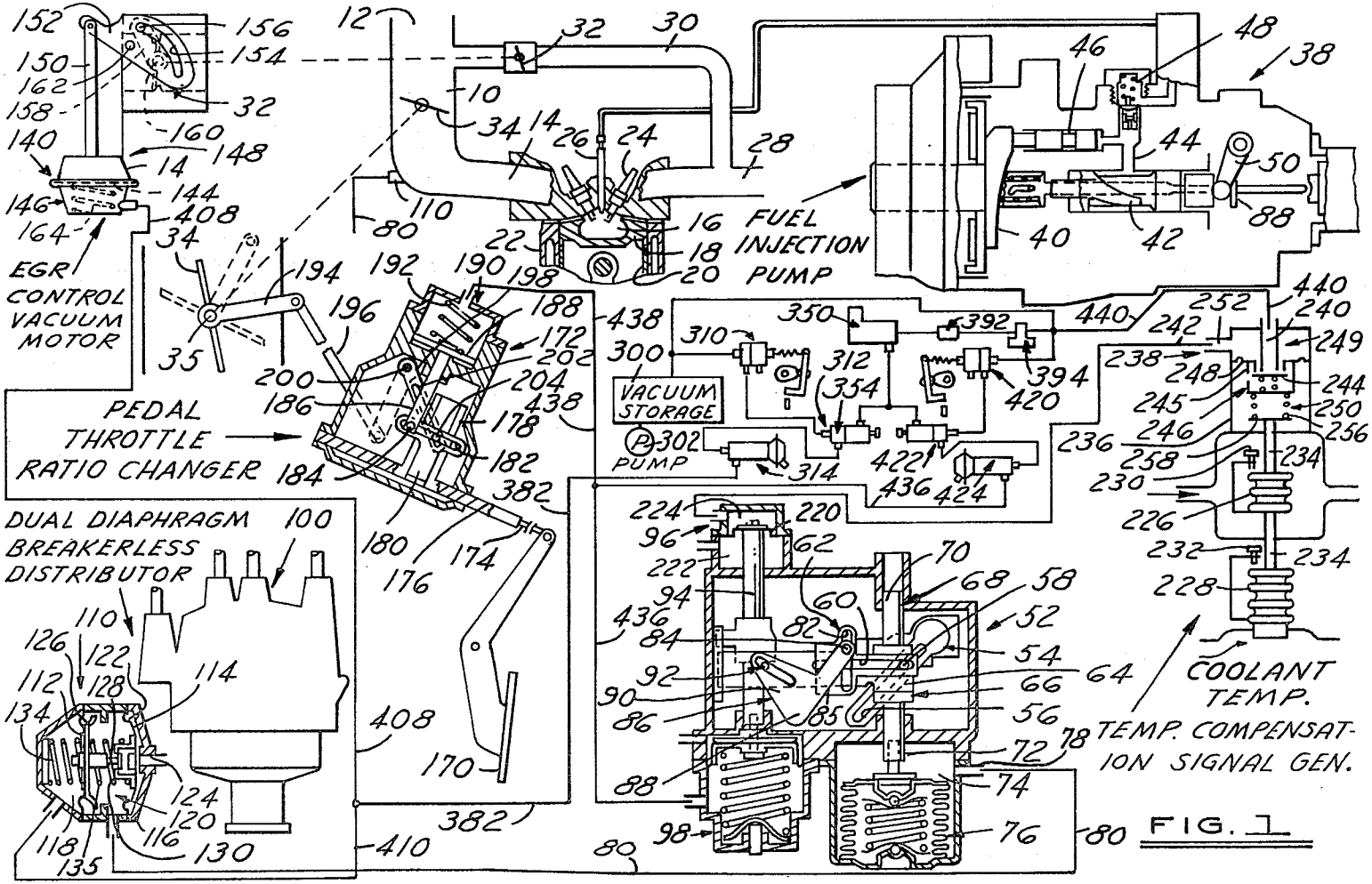

This invention relates in general to an internal combustion engine of the spark ignition, stratified charge, fuel injection type. More particularly, it relates to a fuel injection control system for such an engine that will establish the desired air/fuel ratios to the mixture charge in the engine combustion chamber for different engine operating conditions.

U.S. Pat. No. 3,696,798, Bishop et al, shows and describes a combustion process for a stratified charge, fuel injection type internal combustion engine in which an air/fuel ratio of the mixture charge is established and maintained constant during engine idle and part throttle operating conditions, to obtain good emission control and fuel economy. This constant air/fuel ratio is maintained even though exhaust gas recirculation (EGR) is used to control $No_x$ emission levels by reducing the maximum combustion chamber temperature and pressure.

Copending U.S. patent application Ser. No. 928,213, Fuel Injection Pump Assembly, filed July 26, 1978, now U.S. Pat. No. 4,197,058, and having the same assignee as of this application, shows and describes a fuel injection pump having a face cam pumping member that is contoured to provide a fuel flow output that varies with engine speed in a manner to match mass air flow changes over the entire engine speed and load operating range to provide a constant mixture charge air/fuel ratio.

Copending U.S. patent application Ser. No. 937,693, Air/Fuel Ratio Controller, filed Aug. 29, 1978, also having the same assignee, is directed to an air/fuel ratio controller that provides a mechanical linkage, vacuum controlled mechanism to maintain the constant air/fuel ratio described above in connection with the two devices regardless of changes in engine intake manifold vacuum, intake manifold gas temperature, and the flow of exhaust gases to control $No_x$ levels.

It is an object of this invention to provide a control system that will control the supply of vacuum to a controller of the type in U.S. Ser. No. 937,693 so that the controller in turn can effect the movement of the fuel pump fuel output control lever of an injection pump of the type in U.S. Ser. No. 928,213 to provide the constant air/fuel ratio to the mixture charge called for, or to provide other air/fuel ratios required for various operating conditions of the engine.

More specifically, this invention is directed to a fuel injection fuel control system that, first, controls the fuel flow output from a fuel injection pump in a manner to maintain a base air/fuel ratio to the mixture charge regardless of changes in engine intake manifold vacuum levels, changes in intake manifold charge temperature levels, or changes in the air inlet and engine coolant temperatures while, however, providing for changes for maximum acceleration, idle speed and decelerating conditions; and, secondly, that establishes air/fuel ratios to the mixture charge that are different than the base ratio; and, thirdly, that coordinates the engine ignition timing not only with the opening of the engine throttle valve, but also with the flow of exhaust gases to compensate for any changes in burn rate.

Fuel injection pump assemblies are known that attempt to automatically maintain some kind of air/fuel ratio control in response to changes in air temperature, air pressure, as well as exhaust back pressure. For example, U.S. Pat. No. 2,486,816, Beeh, Fuel Mixture Control for Internal Combustion Engines, shows in FIG. 10 a control system for two fuel injection pumps in which the fuel flow ouput is automatically varied as a function of changes in engine intake manifold vacuum level, manual settings, and intake temperature and exhaust pressure levels. U.S. Pat. No. 2,989,043, Reggio, Fuel Control System, shows in FIG. 6 a mechanical-vacuum system in which a particular air/fuel ratio is chosen by movement of a manual lever 78, that ratio being maintained even though changes occur in air temperature and manifold vacuum levels. FIG. 10 shows the use of such a system with a fuel injection pump 104.

Neither of the above devices, however, operate to provide the finite control of the air/fuel ratio that is provided by this invention, as will be described later, to not only provide a constant base air/fuel ratio, but also modifying means to vary the base ratio to establish others that are more in accordance with selected operating conditions of the engine, to provide better emission control and better fuel economy. Also, neither of the above devices shows any control at all for modifying the fuel output to compensate for the addition of exhaust gases to control $No_x$ levels.

It is another object of this invention to provide a vacuum-mechanical control system in which vacuum activates not only an EGR valve and controls the engine ignition timing but also regulates the movement of an air/fuel ratio controller mechanism that in turn positions the fuel pump fuel output lever, the vacuum level being controlled by a number of mechanically controlled valves that move in response to various operations of the engine. An alternate embodiment provides an electrical-vacuum-mechanical control system in which some of the functions previously performed by mechanically operating valves are integrated by a control module that electrically controls the supply of vacuum again through valving to the air/fuel ratio mechanical linkage controller.

It is a still further object of the invention to provide a fuel injection control system of the type described above in which two separate vacuum circuits are provided, one being connected to the air/fuel ratio controller to modify its position as a function of a number of changing engine parameters during operation of the engine, the other circuit being controlled by the same engine parameters to control the flow of vacuum to the EGR valve actuator and to control the engine ignition timing control device.

Figure 2:
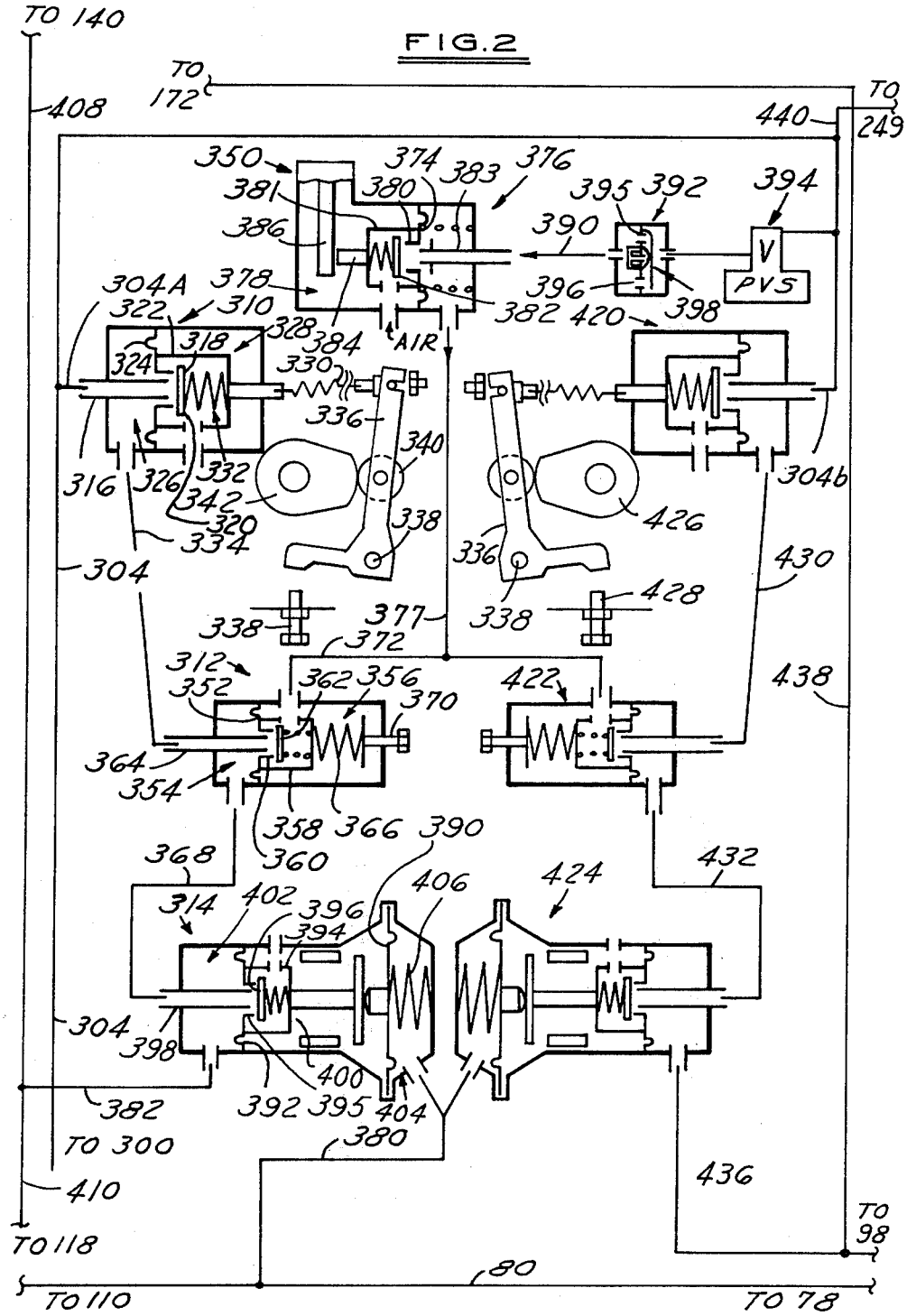
Figure 3:
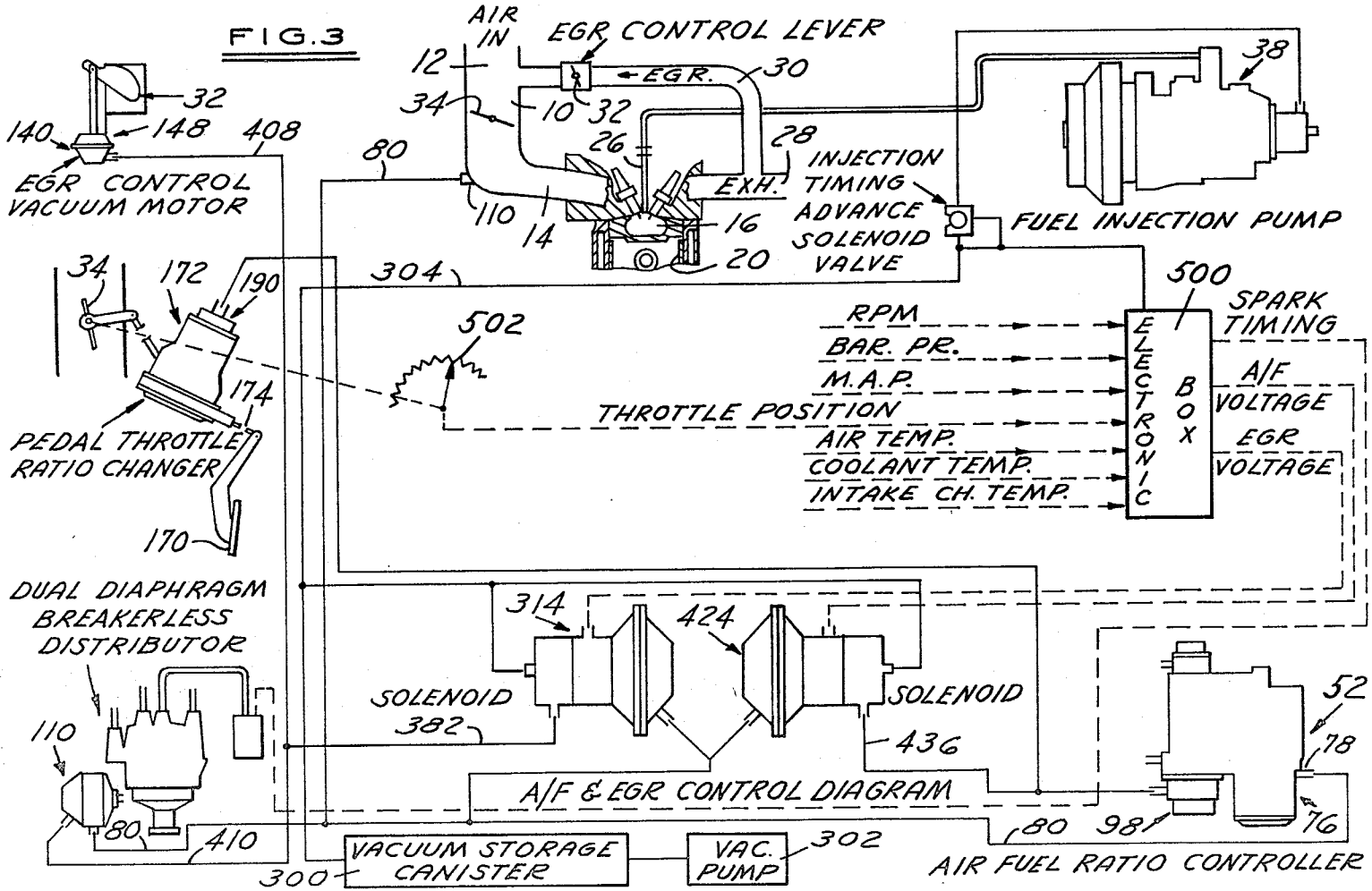

Other objects, features and advantages of the invention will become more apparent upon reference to the succeeding detailed description thereof, and to the drawings illustrating the preferred embodiments thereof; wherein, FIG. 1 schematically illustrates a fuel injection control system embodying the invention;

FIG. 2 is an enlargement of the central portion of FIG. 1; and,

FIG. 3 schematically illustrates an alternate embodiment of the invention.

FIG. 1 illustrates schematically only those portions of the induction and exhaust system of a fuel injection type internal combustion engine to which the control system of the invention relates, as the details and construction of the remaining parts of the engine are known and believed to be unnecessary for an understanding of the invention.

More specifically, the system includes an air-gas intake manifold induction passage 10 that is open at one end 12 to air at essentially atmospheric or ambient pressure level and is connected at its opposite end 14 to discharge through valving not shown into a swirl type combustion chamber indicated schematically at 16. The chamber in this case is formed in the top of a piston 18 slidably mounted in the bore 20 of a cylinder block 22. The chamber has a pair of spark plugs 24 for the ignition of the intake mixture charge formed from the gas in the induction passage 14 and the fuel injected from an injector 26, providing a locally rich mixture and overall lean cylinder charge. An exhaust gas conduit 28 is connected to a passage 30 that recirculates a portion of the exhaust gases past an EGR valve 32 to a point near the inlet to induction passage 10 and above the closed position of a conventional throttle valve 34. Thus, movement of the throttle valve 34 provides the total control of the mass flow of gas (air plus EGR) into the engine cylinder. The EGR valve 32 is rotatable by a servo mechanism 36 shown at the top left hand portion of FIG. 1, to provide a flow of exhaust gases during selected load periods of operation of the engine.

The fuel in this case delivered to injector 26 is provided by an engine driven fuel injection pump 38 of the plunger type shown and described more fully in application U.S. Ser. No. 928,213 referred to above. The pump has a cam face 40 that is contoured to match fuel pump output with the mass air flow characteristics of the engine for all engine speed and load conditions of operations so a constant air/fuel ratio to the mixture charge flowing into the engine combustion chamber 16 will be maintained at all times. The pump has an axially movable fuel metering sleeve valve helix 42 that cooperates with a spill port 44 to block the same at times for a predetermined duration to thereby permit the output from the plunger 46 of the pump to build up in pressure against a delivery valve 48 to open the same and supply fuel to the injector 26. Axial movement of the helix by a fuel control lever 50 will vary the base fuel flow output by moving the helix to block or unblock a spill port 44 for a different duration of time.

FIG. 1 also shows an air/fuel ratio controller or regulator 52 that is connected to the fuel pump lever 50 to change the fuel flow output as a function of manifold vacuum changes (air flow changes) upon opening of the throttle valve 34 so that the air/fuel ratio of the mixture charge flowing to the engine cylinder will remain constant. The regulator also modifies the position of the pump fuel flow lever upon the addition of EGR gases to the intake charge and upon changes in the temperature of the intake charge, as well as upon the occurrence of other events that will be described, each of which changes the oxygen concentration in the charge.

The regulator 52 contains a vacuum controlled, mechanical linkage mechanism that includes an arcuately movable fuel control lever 54. Lever 54 is pivotally connected to the fuel injection pump metering sleeve valve that includes helix 42 so that counterclockwise movement of lever 54 will cause a movement of the pump helix to increase the fuel flow output or rate of flow. A spring (not shown) anchored to the housing normally biases the fuel control lever in a clockwise direction to a minimum or base fuel flow rate position of the helix 42.

The lever 54 is formed with an elongated cam slot 56 through which projects a roller 58 that is mounted in the cam slot 60 of a cross slide 62. The cross slide is mounted for movement within a channel 64 formed in a cross slide guide 66 that is adjustably connected and mounted on a movable rod or shaft 68. Shaft 68 has one end 70 slidably mounted in the housing with its other end 72 projecting through the housing into sealed engine manifold vacuum chamber 74 for attachment to the end of a metallic bellows type aneroid 76. The aneroid 76 is sealed with vacuum inside and subjected to the changes in intake manifold vacuum admitted to chamber 74 through an inlet 78 connected by tubing 80 to the intake manifold 10, as shown. The changes in manifold vacuum level cause a change in the length of the aneroid to move the shaft 68 causing roller 58 to pivot the fuel control lever 54.

The cross slide 62 has formed on its left end an elongated cam slot 82 within which moves a floating roller 84. The roller is pivotally attached to one leg 85 of a fuel enrichment control bellcrank lever 86 pivotally mounted at 88 on the housing and having a second right angled leg portion 90. The leg 90 is connected by a pin and slot type adjustable connection 92 to a movable fuel enrichment control rod 94. A spring not shown normally biases the rod and enrichment lever 86 upwardly as seen in FIG. 1 to move the lever 54 to a maximum engine acceleration position providing the maximum rate of pump fuel flow.

The rod 94 is slidably moved by virtue of a pair of servo vacuum motors 96 and 98 attached to opposite ends of the rod. The servo vacuum motor 96, as will be described in more detail later, is sensitive to a drop in engine air and coolant temperature levels to move the enrichment rod 94 towards a richer air/fuel ratio. Servo motor 98 contains a spring 100 normally biasing a diaphragm type piston 102 upwardly as shown to position the enrichment rod 94, enrichment lever 86, and fuel lever 54 for maximum fuel output from the pump; i.e., a maximum enrichment position. The servo motor 98 is supplied with a controlled or servo vacuum from the control system to be described to variably and gradually position the enrichment rod 94 to thereby gradually and variably change the fuel flow output from the injection pump.

FIG. 1 shows in the lower lefthand portion a known type of engine ignition timing distributor 100. It would have the usual pivotally mounted adjustable plate, not shown, that is movable in opposite directions for controlling advance and retard of the engine ignition timing. A vacuum controlled servo 110 is provided and would be connected to the movable plate for automatically adjusting the ignition timing in accordance with the various operating conditions of the engine.

More specifically, the actuator 110 is of the dual diaphragm type having a pair of annular flexible diaphragms 112 and 114 defining with the housing 116 a servo vacuum chamber 118, a manifold vacuum chamber 120, and an air chamber 122 connected to atmosphere through a hole 124 in the housing. The diaphragm 114 would be directly connected to the adjustable plate of the distributor for moving the same in the opposite directions described. The two diaphragms 112 and 114 are interconnected as shown for a limited axial relative movement between. A retainer 126 has a yoked portion 128 received within a clamp type retainer 130 fixed to diaphragm 114. The construction permits a lost motion movement of diaphragm 112 leftwardly relative to diaphragm 114 until the portion 128 abuts the retainer 130. In the opposite direction, yoke 128 will abut a pad 132 on diaphragm 114. A spring 134 biases both diaphragms rightwardly to provide an initial engine start and wide open throttle retarded ignition timing when manifold vacuum in chamber 120 is zero or nearly so. A second spring 135 lightly separates the diaphragms. The progressive introduction of servo vacuum to rear chamber 118 will cause the yoke 128 to seat against retainer 130 and then the diaphragm 114 will move leftwardly progressively to slowly advance the ignition timing as a function of changes in servo vacuum.

An EGR servo mechanism 140 is provided for actuating the EGR valve 32 between its closed and open positions in accordance with operating conditions of the engine. More specifically, as seen in the upper lefthand portion of FIG. 1, a vacuum motor 140 has an annular diaphragm 144 that divides the servo into a vacuum chamber 146 and an atmospheric vent chamber 148. A rod 150 is attached to the diaphragm and projects from the servo housing for pivotal connection to a bellcrank lever 152. The latter has a cam slot 154 that receives the end 156 of a link 158 fixed to the shaft 160 of the EGR valve 32. The application of vacuum to the servo 140 retracts the rod 150 to pivot the bellcrank 152 about the pivot 162 camming the pin 156 by the slot 154 to progressively open the EGR valve 32. A servo spring 164 normally urges the rod 150 outwardly to the position shown closing the EGR valve.

FIG. 1 also shows in the lefthand middle portion an interconnection between the conventional vehicle accelerator pedal 170 and the throttle valve 34. It includes in this case a pedal throttle ratio changer 172. More specifically, when the accelerator pedal 170 is depressed during cold engine operation to obtain an increase in fuel and, therefore, torque for acceleration purposes, the particular opening of the throttle valve at that time permits a certain amount of air and EGR gases to flow to the combustion chamber. When the engine is warm, the air is less dense. Therefore, for the same depression of the accelerator pedal and opening of the throttle valve, less torque will be produced. The ratio changer device 172 eliminates the need to depress the accelerator pedal further to open wider the throttle valve to obtain the same torque as when the engine was cold. It compensates for the change by changing the throttle valve opening in accordance with temperature conditions.

More particularly, the accelerator pedal 170 is connected by a cable 174 to an actuator rod 176. The latter contains a cross slide guide portion 178 that receives a cross slide 180. The latter has a cam slot 182 in which is mounted a pin 184 to which is pivotally connected the rod 186 of a piston 188. The piston operates in a servo vacuum chamber 190 supplied with the same vacuum that supplies the air/fuel ratio controller servo motor 98. A spring 192 normally biases the piston to the position shown, which in this case is the cold engine position. The throttle valve 34 is connected by links 194 and 196 to an additional lever 198 pivoted at 200 on the housing of the ratio changer. Lever 198 contains a cam slot 202 in which is received a floating roller 204 that also projects through the cam slot 182 of cross slide 180.

As the piston 188 is progressively moved upwardly (as a function of change in load or torque demand,) the amount of travel of the lever 198 will change. That is, the movement of cross slide 182 will pivot lever 198 to open throttle valve 34 more. The ultimate result is that the same torque will be obtained for the same depression of the accelerator pedal 170 even though the throttle valve 34 moves to different open positions as a function of whether the engine is operating warm or cold.

The air/fuel ratio controller servo motor 96, under normal engine operating temperature conditions, does not affect the movement of the fuel enrichment rod 94. It is only when the engine air cleaner air inlet temperature or engine coolant temperature drops below normal indicating cold engine operating conditions that servo 96 will move the enrichment rod 94 upwardly if not already at a maximum enrichment to effect an increase in fuel flow or a richer mixture. The servo contains an annular flexible diaphragm 220 dividing the servo into an air chamber 222 and a vacuum chamber 224. The vacuum chamber is connected to the mechanism as shown in the central righthand portion of FIG. 1 that is controlled by a pair of liquid filled bellows 226 and 228. The bellows 226 is located in the inlet air stream of the air cleaner normally secured over the air induction passage 10 to be sensitive to the temperature of the incoming air. Bellows 228 would be placed in the engine block in the coolant passage. Both bellows under normal operating temperature conditions are expanded against adjustable stop screws 230, 232 that preset the temperature actuation level. The bellows are interconnected by a rod 234 that projects through the valve body 236 containing a valve 238. The latter controls the flow of servo vacuum in a standpipe 240 to a supply line 242 leading to the vacuum chamber 224 of servo motor 96. Valve 238 includes a disc valve 244 lightly spring loaded against the end of the standpipe and against the step like seat of an actuator 246. The actuator has a stepped internal diameter defining the seat, and is secured to an annular flexible diaphragm 248. The diaphragm separates the valve body into a servo vacuum chamber 249 and an air chamber 250 having an opening 252 to atmosphere. The end of the rod 234 is separated from the actuator by a spring 256 seated against a disc 258.

When the air inlet temperature and coolant temperature is normal or above, expansion of the bellows increases the force on spring 258 to maintain the diaphragm 248 and disc 244 upwardly against the end of standpipe 240 and prevent the flow of vacuum to line 242. Diaphragm 248 will have moved the seat 245 out of contact with valve 244, and connected chamber 249 and line 242 to vent.

As the temperature levels of either the air cleaner inlet air or the engine coolant, or both, drops below the normal level, one or the other or both bellows 226 or 228 will contract reducing the force of spring 258. A point will be reached where the atmospheric pressure in chamber 249 on the upper side of diaphragm 248 pushes the diaphragm and step 245 and disc valve 244 downwardly to open the standpipe and connect vacuum to line 242. The amount will depend upon the degree that contraction of the bellows decreases the force. The greater the drop in temperature, of course, the greater the movement of the servo vacuum motor 96 to provide a richer setting of the enrichment rod 94. When the vacuum level in chamber 249 becomes high enough, it will pull upwardly on diaphragm 248 until valve 244 seats against the end of standpipe 240 to again shut off the inlet. Continued upper movement will separate the actuator 246 from the disc valve and permit atmospheric air in port 254 to again flow around the valve and into chamber 250 to decay the vacuum level. The valve mechanism thus will hunt back and forth until an equilibrium position is established providing a predetermined level of vacuum in line 242 corresponding to the position of the bellows and, therefore, the temperature level.

Turning now to the center portion of the figure, i.e., the control system as shown in the central and lower middle portions of FIG. 1, one of the primary objectives is to establish a certain EGR flow schedule so as to control the production of $No_x$ and yet provide good driveability and fuel economy and control the emission of other undesirable elements. There are two ways to control the flow of EGR. One is to increase EGR flow as a function of throttle valve angle; i.e., the more the throttle valve is open, the more EGR, up to wide open throttle conditions. Another way is to control EGR flow as a function of load. Accordingly, two separate vacuum circuits are used in this control system, one, a gas/fuel ratio control circuit to control the air/fuel ratio controller 52 to schedule the fuel pump output flow to maintain certain predetermined air/fuel ratios to the mixture charge; the other circuit being an EGR valve and engine ignition timing circuit controlling the opening and closing of EGR valve and simultaneously the changing of the ignition timing to compensate for a change in burn rate caused by the addition of EGR gases. Both circuits are controlled as a function of throttle valve angle, engine temperature levels, and load conditions.

The actuating force or muscle to effect movement of the various servo mechanisms includes in addition to intake manifold vacuum a servo vacuum supplied by a vacuum storage canister 300 that is maintained at a predetermined level by an engine driven vacuum pump 302. This level would typically be in the range of 15–16 inches Hg. This servo vacuum is supplied through a line 304 in two equal paths to the two vacuum circuits, the EGR valve vacuum circuit 304A and the gas/fuel control vacuum circuit 304B controlling vacuum motor 98 of the air/fuel ratio controller 52.

Each vacuum circuit includes a servo vacuum regulator valve, a cold engine signal reducer valve and a high load signal reducer valve serially controlling the supply of vacuum from the branch servo vacuum lines 304A and 304B. The construction and operation of the like valves in each circuit are exactly the same. Therefore, only one of each will be described.

More specifically, as seen in FIG. 2, the EGR vacuum regulator 310 is atmospheric pressure closed and opened by a spring as a function of the position of throttle valve 34. The valve per se has a valve body through which a standpipe 316 projects for cooperation with a disc valve 318. Valve 318 is lightly spring loaded against the shoulder or seat 320 of a stepped diameter actuator 322 fixed to an annular flexible diaphragm 324. The diaphragm defines with the housing a vacuum chamber 326 and an air or vent chamber 328. A tension spring 330 is secured to actuator 322. The actuator has a hole connecting the chamber 332 to vent as shown.

In the absence of the force of spring 330, atmospheric pressure acting on the diaphragm 324 will move the actuator leftwardly to seat the disc valve 318 against the standpipe and prevent any flow of reservoir vacuum in line 304A to the chamber 326 and outlet 334. Spring 330 in this case is connected to a lever 336 pivotally mounted at 338. The lever has a roller 340 engaged by the face of a cam 342 fixed on the throttle shaft 35. The face of the cam is contoured to provide an increasing spring force to generate a vacuum signal in outlet line 334 that corresponds to the desired EGR flow at various rotative positions of the throttle valve. Increasing the force of spring 330 by movement of the throttle shaft cam 342 retracts the valve actuator 322 to unseat the valve 318 from the standpipe and admit servo vacuum into line 334. Depending upon the position of the throttle shaft, the vacuum buildup against the righthand side of diaphragm 324 will eventually pull the diaphragm rightwardly to seat the valve 318 against the standpipe. Further leftward movement of the diaphragm by the vacuum in chamber 326 will gradually connect the chamber 326 to vent. This will continue until an equilibrium position is obtained for the particular throttle valve setting.

An adjustable idle speed EGR stop 338 is provided for cooperation with an extension of lever 336 to predetermine the idle speed EGR flow. For example, during idle operation, some EGR flow may be desired. Therefore, the stop 338 will be adjusted so that the regulator will permit say 9 inches of vacuum, for example, when the throttle valve is in idle speed position. As the throttle valve opens, the vacuum will rise to 14 inches or whatever is the level of the vacuum in the storage canister 300.

The cold engine EGR signal reducer valve 312 is similar in construction to valve 310. The valve normally provides a flowthrough of vacuum from valve 310 without any modifications so long as the engine is warm. For a cold engine, valve 312 will reduce the vacuum signal to vary the EGR flow. In this case, the valve is normally closed and is opened by reservoir vacuum, the level of which is controlled by a temperature responsive valve 350.

The valve 312 contains a housing having an annular flexible diaphragm 352 defining a vacuum chamber 354 and a second chamber 356 alternately connected to air of vacuum. An actuator 358 has an internal stepped diameter providing a step 360 that cooperates with a disc valve 362 lightly loaded to seat against the end of a standpipe 364. The actuator is urged by a spring 366 to seat valve 362 and prevent the flow of servo vacuum in line 334 and standpipe 364 to line 368 and valve 314. A screw adjustment 370 is provided for varying the force of spring 366. Introduction of reservoir vacuum in the line 372 from valve 250 will pull the diaphragm 352 rightwardly and cause the disc valve 362 to unseat from the standpipe 364 to allow EGR control servo vacuum to enter chamber 354 and line 368. The level of vacuum and the gradualness of buildup will be determined by the level of vacuum admitted to line 372. For example, if the vacuum in line 372 is low, when the servo vacuum level in line 368 becomes high enough, any further increase will pull the diaphragm 352 leftwardly, seat the disc valve 362 against the standpipe, and further rightward movement of the diaphragm will connect chamber 354 to chamber 356 to equalize the forces on the elements. The connection of line 372 to air would cause valve 312 to operate in a similar manner but regulate at a different level.

The temperature signal reducer valve 350 is of slightly different construction. It contains the usual annular flexible diaphragm 374 dividing the valve body into a vacuum chamber 376 and an atmospheric air or vent chamber 378. Secured to the diaphragm is an actuator having an internal stepped diameter providing a shoulder 380 for cooperation with a disc valve 382 lightly spring loaded thereagainst for seating against the end of a standpipe 383 connected to reservoir vacuum. The actuator has a stem 384 in this case fixed to a bimetallic sensor 386 that moves gradually from the solid line position to the dotted line position above a predetermined engine coolant temperature level of, for example, 45° F. The standpipe 383 receives vacuum from a line 390 that contains a vacuum delay valve 392 and a temperature responsive on off valve 394. The vacuum delay valve 392 has an inlet, and outlet as shown, and a central partition 395. The partition has a pair of orifices 396 and a central oneway check valve 398. The orifices 396 provide slow application of vacuum from the temperature responsive valve 394 to the signal reducer valve 350 since the pressure on the left side of the delay valve 392 is higher than on the right side, which will keep the check valve 398 seated. Flow in the other direction will unseat the check valve and provide fast venting of the vacuum chamber 376 of valve 350. The temperature responsive valve 394 will be activated by means not shown to open quickly to admit the reservoir vacuum to the delay valve 392 in response to the engine reaching a predetermined operating temperature level.

Assume the engine is operating at below normal temperature levels. When the level is reached at which the bimetal sensor 386 is set, the bimetal will move slowly leftwardly from the solid to dotted line position. This will pull the actuator 381 with it and cause a gradual unseating of the disc valve 382 from the standpipe 383. Accordingly, vacuum will be slowly admitted to chamber 376 to flow through line 377 to line 372 of the EGR signal reducer valve 312.

The purpose of the high load EGR signal reducer valve 314 is to gradually close the EGR valve and, therefore, decrease EGR flow when maximum acceleration and torque is demanded. The valve 314 is controlled by manifold vacuum connected thereto by a line 380. Under light and moderate manifold vacuums, i.e., down to a 2" Hg. level, the valve will remain open to pass through to line 382 any vacuum in line 368. During the last two inches of decreasing manifold vacuum, indicative of high loads, valve 314 will gradually close to terminate the flow of vacuum to line 382.

The vacuum valve 314 includes a valve housing having two annular flexible diaphragms 390 and 392 of different areas spaced by and connected to an actuator 394. The actuator has a stepped internal diameter, the step 395 of which cooperates with a disc valve 396 lightly loaded to seat against the end of a standpipe 398. The standpipe is connected to EGR control servo vacuum line 368. The two diaphragms 390 and 392 define an atmospheric vent chamber 400. Diaphragm 392, with the housing, defines an outlet servo vacuum chamber 402 connected to line 382. Diaphragm 390 together with the housing defines a manifold vacuum chamber 404 connected to line 380. So long as the manifold vacuum in chamber 404 is higher than two inches Hg., the actuator 394 will be moved to pull the disc valve 396 off the standpipe 398 and permit EGR servo vacuum in line 368 to enter chamber 402 and flow to line 382. During the last two inches Hg. of manifold vacuum level, under high load conditions, the force of spring 406 gradually moves the actuator 394 to slowly seat the disc valve 396 against the end of the standpipe 398 to progressively block off further flow of vacuum to line 382.

Outlet line 382 is branched to supply servo vacuum through a line 408 to the EGR servo 140, and through a line 410 to the ignition distributor timing control servo 110.

The second vacuum circuit, i.e., the gas/fuel control vacuum circuit is supplied with vacuum from the vacuum storage canister 300 in line 304 through the line 304B to the air/fuel ratio controller vacuum motor 98 past a G/F servo vacuum regulator 420, a G/F cold engine signal reducer valve 422, and a high load G/F signal reducer valve 424. The valves 421, 422, and 424, as stated previously, are identical in structure and operation to their counterparts valves 310, 312, and 314, in the first vacuum circuit. The details of construction of the valves 421, 422, and 424, therefore, will not be repeated, and they operate in the same manner. Vacuum from the reservoir or canister 300 will flow in line 304B past the servo vacuum regulator valve 420 as a function of the opening angles of the throttle valve controlled by the cam 426 and the initial position of the idle gas/fuel adjustable stop 428. Vacuum will flow through a line 430 to the cold engine G/F signal reducer valve 422, and if the engine operating temperature is normal, the vacuum will flow through valve 422 without modification to the valve 424. Valve 424 will permit passthrough of vacuum to the servo 98 as a function of load, closing the line under high load conditions while opening the same under moderate and light load conditions.

The operation is believed to be clear from the above description. However, to summarize, under engine off conditions, no vacuum exists in the system. The EGR valve 32 will be closed, the throttle valve 34 will be closed, the G/F control vacuum motor 98 will be positioned by its spring 100 to move the fuel enrichment control lever 60 and fuel lever 54 to position the pump fuel lever to a maximum fuel flow position. If this fuel flow rate is not desired for engine starting, other means not shown may be connected to override the pump lever position for starting purposes.

Assume now the engine is started, and the engine is cold. A richer air/fuel mixture is usually called for. With the engine at idle speed condition, the vacuum storage canister 300 will supply a reservoir vacuum at a level of approximately 15-16 inches Hg. to the EGR and G/F servo vacuum regulators 310 and 420, as well as to the standpipe 240 of the air inlet and engine coolant temperature control valve unit 238. The reservoir vacuum is also supplied to temperature responsive valve 394. Intake manifold vacuum is supplied by line 80 to the chamber 120 of the distributor ignition timing control servo 110. The forces being balanced against opposite diaphragms permits the rear spring 134 to move the distributor advance plate in a direction to provide an initial retarded ignition timing. The manifold vacuum is also supplied by line 80 to the air/fuel ratio controller chamber 74 containing the aneroid capsule 76. High manifold vacuum expands the aneroid 76 to pivot the fuel control lever 54 clockwise towards its minimum fuel pump fuel lever fuel flow position.

The temperature responsive valve 394 will be closed so that no vacuum flows past valve 350 to line 372 to the cold engine signal reducer valves 312 and 422. Therefore, these latter valves permit only a minimum level vacuum flow from lines 334 and 430 into lines 368 and 432. At idle, manifold vacuum in line 380 will be high so that valves 314 and 424 will pass through the servo vacuum in lines 368 and 434 without modification to EGR line 382 and the G/F vacuum line 436.

The vacuum in EGR vacuum line 382 will flow to line 408 to actuate the EGR servo 140 to open the EGR valve a predetermined amount. This will flow a scheduled amount of EGR gases into the intake manifold 10 above the throttle valve 34. Simultaneously, the same vacuum will flow from line 382 to line 410 to be applied to the rear chamber 118 of the distributor ignition timing servo 110 causing a leftward movement of the diaphragm 126 until stopped by engagement of the yoke 128 with the retainer 130. Depending upon the vacuum level, the timing may or may not be changed from its initial retarded setting.

The flow of EGR gases reduces the concentration of oxygen in the gas mass flow to the engine; for the same throttle valve opening. Therefore, the fuel flow should be decreased if a constant air/fuel ratio to the mixture charge is to be maintained. This is accomplished by the vacuum in the G/F line 436. The vacuum flow in line 436 to servo 98 will cause the enrichment rod 94 to move downwardly to a leaner air/fuel ratio position; i.e., it will cause a resultant movement of the fuel lever 54 and the fuel pump lever 50 to reduce fuel flow. The G/F vacuum line 436 is also connected by a line 438 to chamber 190 of the pedal throttle pedal ratio changer 172 pulling the piston 188 upwardly and, therefore, changing the ratio of the mechanism. This results in a wider opening of the throttle valve for the same depression or setting of the accelerator pedal 170.

With the engine cold, the air inlet and coolant temperature responsive bellows 226 and 228 will be contracted to open the control valve 238 and permit vacuum in line 440 from reservoir 300 to be gradually applied through line 242 to the servo piston 96 of the air/fuel ratio controller 52. This tends to move the enrichment rod 94 in a fuel enrichment direction.

The vacuum control system will operate in a similar manner upon continued depression of the vehicle accelerator pedal. Continued rotation of the throttle shaft cams 342 and 426 gradually admit more vacuum to the EGR and G/F lines 382 and 436 as a function of engine load conditions. The wider the throttle valve is open, the more EGR gas will flow, the more the ignition timing will be advanced, and the more the G/F control vacuum motor 98 will be moved towards a leaner air/fuel ratio position; i.e., a fuel flow decreasing position. At wide open throttle operation, the high load signal reducer valves 314 and 424 will completely shut and cause the EGR valve to close and the vacuum servo 98 to move the enrichment rod 94 to its maximum fuel flow position. At the same time, the engine ignition timing will be returned to a retarded setting.

When the engine has warmed, the temperature responsive valve 394 will open and gradually apply reservoir vacuum through the delay valve 392 and line 390 to the temperature signal reducer valve 350. The bimetal 386 of valve 350 will gradually move so that a gradual application of vacuum will be applied to the cold engine signal reducer valves 312 and 422. This will open both valves completely to pass the vacuum in EGR line 334 and G/F line 430 to the high load signal reducer valves 314 and 424. The signal thereafter will then be controlled as a function of the load to actuate the EGR valve 32 or not as the case may be and change the engine ignition timing accordingly, while at the same time the G/F vacuum line 436 will control gradually and automatically the position of the cold enrichment rod 94 and lever 60 to progressively change the fuel pump fuel flow lever position to establish the air/fuel ratio called for. It will also control the position of the throttle valve 34 through the throttle pedal ratio changer 172. Simultaneously, the manifold vacuum acting on aneroid 78 moves the fuel control lever 54 so that the combined signals from the aneroid and vacuum motors 98 and 96 are integrated to provide an output movement of fuel lever 54. At this time, the temperature of the engine coolant and air cleaner inlet air temperature being normal or above the normal engine operating temperature level, the valve 238 will be closed and the servo 96 will be ineffective to control the position of the enrichment rod 94.

FIG. 3 shows an alternate embodiment in which an electronic module 500 is used to perform electronically a number of the functions provided, for example, by the mechanically operating servo vacuum regulator valves 310 and 420 in FIG. 1, and the cold engine signal reducers 312 and 422, as well as the air inlet and engine coolant temperature compensation signal generator 238. A microprocessor having input signals as indicated would reflect changes in RPM, barometric absolute pressure, manifold absolute pressure, the angular position of the throttle valve as determined by a potentiometer 502, the air cleaner air inlet temperature, the engine coolant temperature, and the intake manifold gas charge temperature. The microprocessor unit 500 would be programmed to provide the same signal output as described in connection with FIG. 1 by means of a variable voltage indicated to control the engine ignition spark timing as a function of throttle valve angle and EGR flow and the level of gas/fuel control vacuum to properly position the mechanical linkage of the air/fuel ratio controller 52 to maintain the constant air/fuel ratio to the mixture charge or whatever other air/fuel ratio is called for as a result of the engine operating conditions input to the microprocessor. The mechanical high load vacuum signal reducer valves 314 and 424 shown in FIG. 1 would be modified only to the extent of including a solenoid in the valve body with an armature connected to the valve actuator, for example, 394, so as to progressively move the actuator in response to a gradual application of voltage to the solenoid as dictated by the microprocessor to gradually increase or decrease the vacuum output to the EGR line 382 or the G/F vacuum line 436.

In all other respects, the operation of the vacuum system in FIG. 3 is essentially the same as that in FIG. 1. The air/fuel ratio controller 52 would continue to be regulated as a function of changes in intake manifold vacuum acting on the air/fuel ratio controller aneroid 76, and the changes in G/F vacuum level acting on the servo 98, the mechanical linkage of the controller logarithmically integrating the signals to provide the desired movement of the fuel flow control lever 54 so that the pump fuel flow control lever 50 will also be moved as called for.

From the foregoing, it will be seen that the invention provides a fuel injection fuel control system that will regulate an injection pump fuel flow output in a manner to provide a constant air/fuel ratio to the mixture charge in the engine combustion chamber, and that the fuel flow is changed as a function of intake manifold vacuum changes modified by changes in engine operating temperatures or exhaust gas flow, and changed for maximum acceleration purposes, and that the engine ignition timing is coordinated with the flow of EGR gases to compensate for the change in concentration of oxygen in the mixture charge thereby resulting in a different burn rate; and that the air/fuel ratio can be changed infinitely to meet specific engine operating requirements. It will also be seen that the control system provides an infinite control by a number of adjustments to provide various air/fuel ratios to the mixture charge.

While the invention has been shown and described in its preferred embodiments, it will be clear to those skilled in the arts to which it pertains that many changes and modifications may be made thereto without departing from the scope of the invention.

We claim:

1. A fuel injection control system for an internal combustion engine of the spark ignition type including an air-gas induction passage open at one end to air at ambient pressure level and connected at its other end to the engine combustion chamber to be subject to manifold vacuum changes therein, a throttle valve rotatably mounted for movement across the passage to control the air-gas flow therethrough, an exhaust gas recirculation (EGR) system including EGR passage means connecting engine exhaust gases to the induction passage above the closed position of the throttle valve, an EGR flow control valve mounted therein for movement between open and closed positions to control the volume of EGR gas flow, an engine ignition timing control device movable to vary the timing, an engine speed responsive positive displacement type fuel injection pump having a fuel flow output to the injector that varies as a function of changes in engine speed to match fuel flow and mass air flow through the induction system of the engine over the entire speed and load range of the engine to maintain the intake mixture ratio of air to fuel constant, an air/fuel ratio regulator operably connected to the pump and movable in response to changes in intake manifold vacuum connected thereto to vary the fuel output of the pump to maintain a constant air/fuel mixture ratio, a first vacuum circuit having a source of vacuum operably connected in parallel flow relationship both to the EGR valve and to the ignition timing control device for providing an adjustment of the ignition timing whenever the EGR flow is adjusted so as to compensate for the change in air/fuel mixture charge burn rate whenever the quantity of EGR gas in the mixture charge is varied, a second vacuum circuit connecting the source of vacuum to the air/fuel ratio regulator for modifying the regulator movement that normally is made in response to changes in intake manifold vacuum alone so as to compensate for changes in the concentration of oxygen in the gas mass flow to the engine whenever the rate of EGR flow changes upon movement of the throttle valve, to thereby maintain a constant air/fuel ratio, the second circuit including first vacuum controlled means connected to the regulator for modifying the movement of the regulator as a function of driver demand signal as indicated by the open angle of the throttle valve and as a function of engine load conditions, to change the pump output to provide the constant air/fuel ratio at times as well as at other times an air/fuel ratio other than the constant air/fuel ratio, and the first vacuum circuit including second controlled means operably interconnecting the EGR valve and throttle valve and engine ignition timing device.

2. A control system as in claim 1, the regulator including mechanical linkage means interconnected to a fuel flow control lever on the pump movable to vary the fuel output rate of flow, and a first vacuum responsive servo means connected to the linkage and movable in response to changes in intake manifold vacuum to change the position of the linkage and pump fuel lever.

3. A control system as in claim 2, the source of vacuum being essentially at a constant level, the first vacuum controlled means including a second vacuum responsive servo connected to the source of vacuum and to the linkage means for normally biasing the linkage means in a pump fuel flow output increasing direction and movable by the source vacuum in a pump fuel flow output decreasing direction to lean the constant air/fuel ratio maintained by the first servo, and metering valve means movable by the throttle valve for metering the supply of vacuum from the source to the second servo.

4. A system as in claim 2, the second controlled means including a second vacuum servo connected to and moving the EGR valve, and vacuum passage means interconnecting the second servo and timing device.

5. A system as in claim 1, the first vacuum controlled means including a first servo connected to the regulator having spring means biasing the regulator towards a fuel pump maximum fuel output position and operable by vacuum applied thereto to variably move the regulator in a fuel pump fuel output decreasing direction, vacuum line means connecting the vacuum source to the first servo, and control means in the line variably controlling the flow of vacuum to the first servo.

6. A control system as in claim 5, the control means including a first metering valve variably movable between closed and open positions in response to movement of the throttle valve to supply a variable vacuum level to the first servo to provide stepless changes in the fuel pump output.

7. A control system as in claim 6, the control means including other means for modifying the vacuum level output of the first valve as a function of changes in an operating temperature of the engine to provide an air/fuel ratio different than the constant air/fuel ratio.

8. A control system as in claim 7, the control means including further means to modify the vacuum level output of the first valve as a function of changes in engine load to provide a richer than the constant air/fuel ratio of the mixture charge during engine wide open throttle valve operation.

9. A control system as in claim 6, including means responsive to operation of the engine at below normal engine operating temperature levels to restrict the flow of vacuum from the first valve to the first servo.

10. A control system as in claim 3, including, vacuum line means connecting the source to the second servo, and valve means in the vacuum line means operable between maximum and minimum openings to control the vacuum level supplied to the second servo to control the air/fuel ratio.

11. A control system as in claim 10, the valve means including a first metering valve operably connected to and movable variably by the throttle valve to open positions as a function of the opening of the throttle valve.

12. A control system as in claim 11, the valve means including a second valve in the line means in series flow relationship with and downstream of the first valve and movable from a maximum open position to a minimum open position in response to the operation of the engine at below normal engine operating temperature levels to further restrict the vacuum level output to the second servo.

13. A control system as in claim 12, including a third valve in the line means in series flow relationship with and downstream of the second valve and movable from an open to a closed position as a direct function of the increase in engine load as indicated by manifold vacuum applied to the third valve.

14. A control system as in claim 13, including a third vacuum servo connected to the regulator linkage means in force opposition to the second servo, and means responsive to operation of the engine with the air in the inlet of the induction passage and the engine coolant at below predetermined temperature levels to move the linkage means to change pump fuel flow output to correct the air/fuel ratio.

15. A control system as in claim 3, the first vacuum controlled means including a vacuum supply line connected to the source and to the second servo, and valve means in the supply line variably movable in response to changes in engine load as indicated by changes in manifold vacuum and in response to operation of the engine at below normal engine operating temperatures and in response to movement of the throttle valve, to vary the supply of vacuum to the second servo to provide a stepless variation of the pump fuel flow output and air/fuel ratio.

16. A control system as in claim 3, the second controlled means including a third vacuum controlled EGR servo connected to the EGR valve for moving the EGR valve, a vacuum supply line connected to the source and to the third servo and to the ignition timing device, and metering valve means variably movable in the vacuum line in response to movement of the throttle valve operably connected thereto to control the concurrent supply of and level of vacuum to the EGR valve and ignition timing device.

17. A control system as in claim 16, the valve means including a first valve operably connected to the throttle valve to be opened as a function of the opening movement of the throttle valve to supply a variable vacuum level to the EGR servo and ignition device.

18. A control system as in claim 17, including a second valve in the line downstream of the first valve and movable by manifold vacuum applied thereto variably from a closed position to an open position as a direct function of increases in engine operating load conditions up to a predetermined level for controlling the flow of vacuum to the EGR valve to control the flow of EGR gases to the induction passage, the second valve closing above the predetermined load level in response to decay of the manifold vacuum acting thereon to close the EGR valve.

19. A control system as in claim 18, including a third valve in the vacuum line between the first and second valves, and temperature responsive means operably connected to the third valve to decrease the flow of vacuum through the third valve to the second valve from the first as a function of decreases in temperature below a predetermined level.

20. A control system as in claim 15, the second controlled means including an EGR servo connected to the EGR valve for moving the EGR valve, means connecting the supply line to the EGR servo, and second valve means in the supply line movable variably between minimum open and maximum open positions in response to movement of the throttle valve and in response to operation of the engine at below engine normal operating temperature levels and in response to changes in the engine load as indicated by changes in manifold vacuum acting on the second valve means, to vary the supply level of vacuum to the EGR servo to provide a stepless and gradual opening and closing of the EGR valve.

21. A control system as in claim 21, including means connecting the supply line to the ignition timing control device for concurrent actuation thereof with the actuation of the EGR servo.

* * * * *